United States Patent [19]

Knappstein et al.

[11] 4,032,409

[45] June 28, 1977

[54] SEALING DEVICE FOR A COKE OVEN DOOR

[75] Inventors: Johannes Knappstein, Recklinghausen; Heinrich Tewes, Essen; Robert Woikowski, Gelsenkirchen-Horst, all of Germany

[73] Assignees: Firma Carl Still; Ruhrkohle AG, both of Germany

[22] Filed: June 11, 1975

[21] Appl. No.: 585,819

[30] Foreign Application Priority Data

June 14, 1974 Germany ..... 2428698

[52] U.S. Cl. ..... 202/248; 202/269

[51] Int. Cl.[2] ..... C10B 25/16

[58] Field of Search ..... 202/242, 247, 248, 269; 110/173 R

[56] References Cited

UNITED STATES PATENTS

| | | | |
|---|---|---|---|
| 2,778,785 | 1/1957 | Otto | 202/248 |
| 3,629,094 | 12/1971 | Silverblatt | 202/248 |
| 3,875,018 | 4/1975 | Calderon | 202/269 X |
| 3,876,506 | 4/1975 | Dix et al. | 202/248 |

FOREIGN PATENTS OR APPLICATIONS

| | | | |
|---|---|---|---|
| 738,975 | 9/1943 | Germany | |
| 7,241,300 | 3/1973 | Germany | |
| 834,689 | 2/1952 | Germany | 202/248 |

*Primary Examiner*—Morris O. Wolk
*Assistant Examiner*—Arnold Turk
*Attorney, Agent, or Firm*—McGlew and Tuttle

[57] ABSTRACT

A sealing device for a coke oven door comprises first and second spaced apart metal sealing blades having respective substantially aligned sealing edges adapted to extend outwardly from the edge of the coke oven door. A metal spacer is mounted between the first and second sealing blades at a location spaced inwardly from the sealing edges and an elastic sealing strip is located between the two blades and has an outer elastic sealing edge which is substantially in alignment with or projects outwardly slightly beyond the blade sealing edges, and bears against the door frame.

5 Claims, 2 Drawing Figures

SEALING DEVICE FOR A COKE OVEN DOOR

BACKGROUND OF THE INVENTION

1. Field of the Invention

This invention relates in general to the construction of coke ovens and in particular to a new and useful coke oven door sealing device which includes two sealing blades which are spaced apart by a spacer and clamped to a coke oven door so that sealing edges of the blades are aligned in a plane spaced outwardly from the edge of the door and which includes a resilient seal member between the blades in the space not occupied by the spacer between the blades and having a sealing edge substantially in alignment with the edges of the sealing blades.

2. Description of the Prior Art

Sealing devices are known which include clamping mechanisms which operate to position a sealing strip assembly composed of inner and outer plates with an elastic strip therebetween which is applied against a door frame surface provided for this purpose. Such a sealing device is known for example from the German Utility Model 7,241,300. In this case the sealing is effected only by the strip of elastic material and no sealing contact of the metal strips with the door frame is provided. Therefore it is true that the thrusting by hand of the metal strips into tight contact is not necessary and instead an expensive manual operation becomes necessary due to the fact that the elastic material of the sealing strip is subject to compression and therefore must be slightly pulled forth from between the metal strips. There is also the further necessity that the elastic sealing strip between the metal plates be realigned and retightened continuously by compressing the metal strips together by a clamping mechanism.

SUMMARY OF THE INVENTION

The present invention provides a sealing device which remains tight over long periods of service and in which both the strip of elastic material and the enclosing metal strips contribute to the sealing effect. At the same time the elastic strip after being compressed by long lasting use can be pushed forward from between the two metal strips or blades so that it will project outwardly further in the direction of the oven door frame.

In accordance with the invention two metal plate sealing blades are spaced apart by a metal spacer and clamped along the edge of the door to be sealed so that the outer sealing edges of the blades project beyond the edge of the door. In addition an elastic sealing member is located in the space between the blades extending from the spacer outwardly to the sealing edges of the blades or slightly beyond. The elastic member extends approximately to substantially half the height of the blades and a metal spacer is located inwardly from the elastic seals and is clamped in position between the blades by a clamping member such as a clamping bolt mounted on the coke oven door. The construction is such that with the door closed the two sealing blade edges and the sealing edge of the elastic seal are all disposed so that they are pressed against the door frame in tight sealing engagement therewith.

The metal strip forming a spacer between the sealing blades and the sealing blades themselves may be a single contour strip and they are provided with suitable recesses or slots to accommodate the clamping bolts which secure them to the door. The spacer strip may also advantageously be divided into several pieces along its length and oriented between the blades between two sets of clamping mechanisms for example along a door edge. The clamping mechanism advantageously comprises a hook bolt which extends over the outer plate blade and compresses the blade assembly with the resilient sealing member together. The construction is such that the central spacer may be shifted in a direction toward the seal plane in order to press the resilient member outwardly from between the outer two blades. In this way the sealing strip may be easily aligned in respect to the door frame. In the preferred construction both a metal seal and an elastic sealing is accomplished. The sealing blades are advantageously provided with bevelled or sharpened sealing edges and the blades are advantageously positioned so that the elastic sealing strip widens in a direction outwardly toward the sealing edge or plane. In this manner the elastic sealing strip can be adjusted so as to project beyond the edges of the sealing blades and a good elastic seal is obtained without excessively compressing and upsetting the material.

Accordingly it is an object of the invention to provide a sealing device for a coke oven door which comprises first and second spaced apart metal sealing blades with a spacer therebetween with means for clamping the blades on a coke oven door so that the sealing edges of the blades extend outwardly from the edge of the door and which includes a resilient sealing member compressed from the blades and extending outwardly from the spacer to at least a plane of the sealing edges.

A further object of the invention is to provide a sealing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

GENERAL DESCRIPTION OF THE PREFERRED EMBODIMENTS

Figure 1:
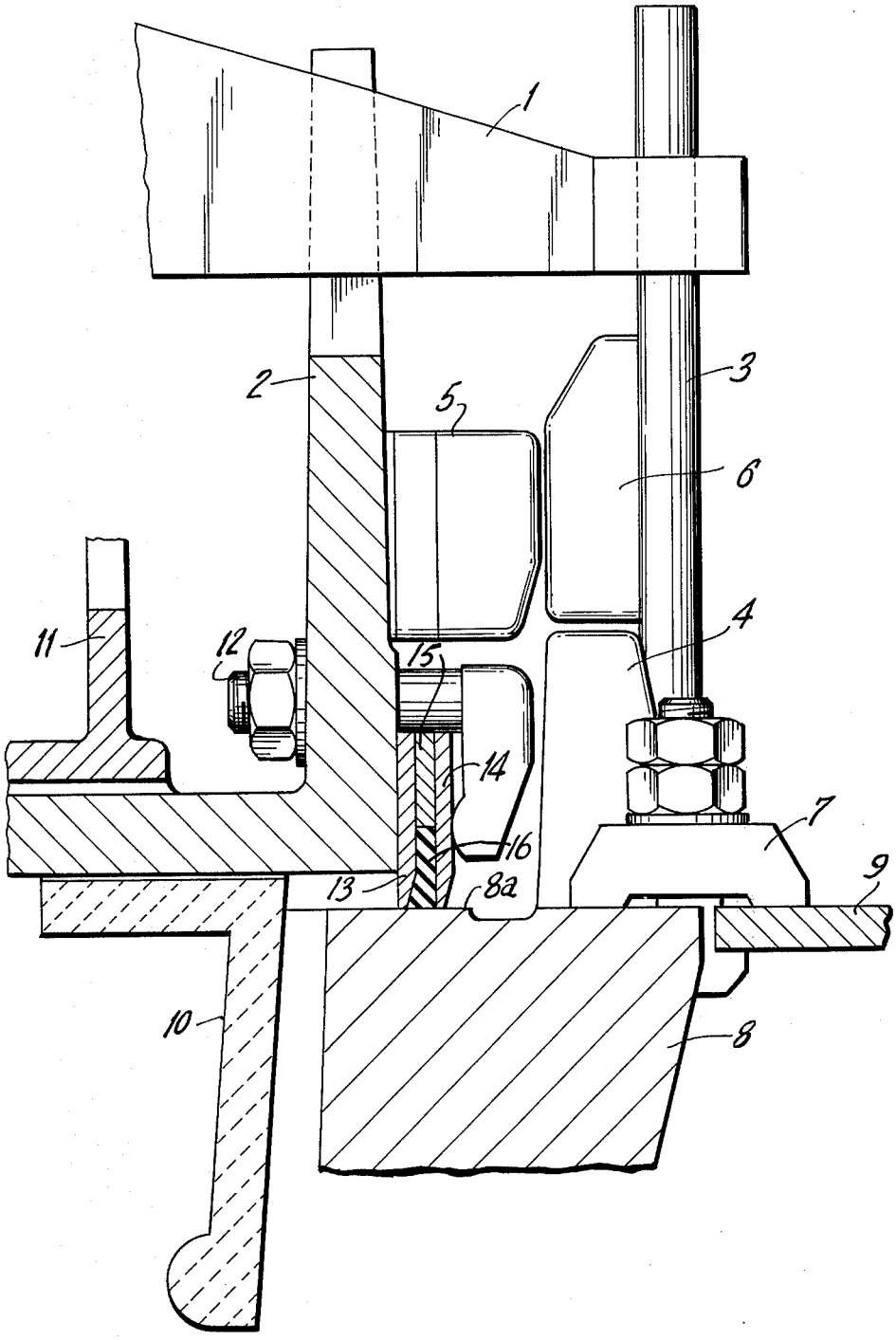
FIG. 1 is a partial sectional view of a coke oven door frame and door having a sealing device constructed in accordance with the invention.

Referring to the drawing in particular the invention embodied therein comprises a coke oven door sealing device which includes a door body 2 having a locking bar 1 associated therewith which carries a locking hook 3. A member 4 secures the locking hook 3 to the door frame 8. A guide lug 5 provided on the door body 2 cooperates with a guide lug 6 provided on the locking hook 3. A clamping support 7 is screwed to a door frame 8 of the oven chamber and also to a steel plate lining 9. A stone or foundation support 10 is located alongside the door frame 8. A locking member 11 is located behind the door body 2. A hook bolt 12 extends through the door frame and it comprises a nut and a washer and engages over a sealing assembly constructed in accordance with the invention.

In accordance with the invention the sealing assembly includes an internal or first sealing blade 13 which is spaced inwardly from an outer sealing blade 14 by a spacer 15 which is disposed therebetween. In accordance with a feature of the invention an elastic sealing strip 16 extends from the lower edge of the spacer 15 in a direction outwardly toward the outer sealing edges of the blades 13 and 15 which extend beyond the edge of the door 2.

In the embodiment of FIG. 1 the first sealing blade 13 has a lower bevelled edge which flares outwardly in a direction toward the sealing plane comprising a surface 8*a* of the door frame 8. In such a construction the elastic seal 16 widens outwardly toward the sealing plane 8*a* and this enlarged sealing strip provides an increased seal area.

Figure 2:
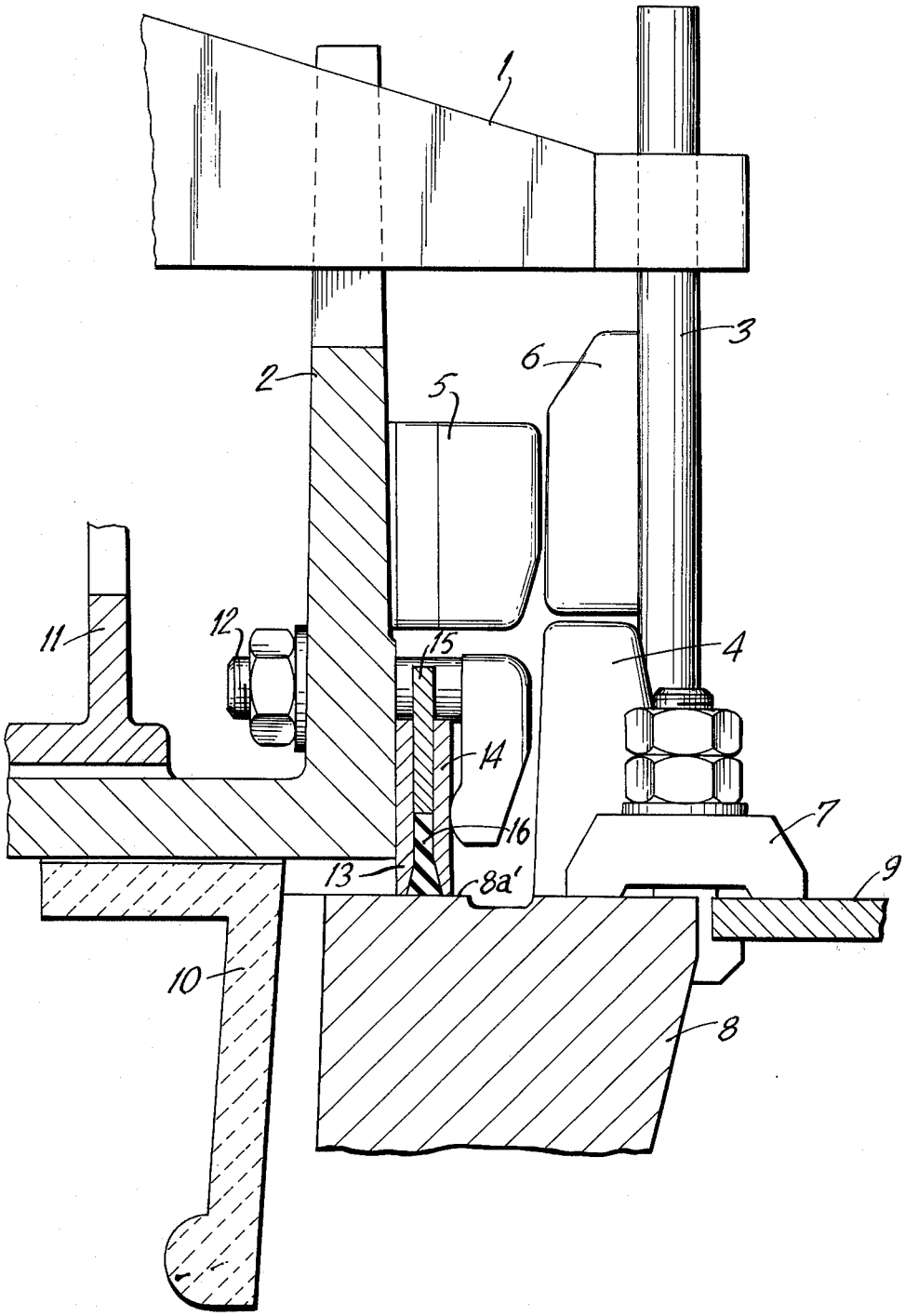
FIG. 2 is a view similar to FIG. 1 of another embodiment of the invention.

In the embodiment of FIG. 2 where similar parts are similarly designated the outer plate 14 is reversed so that its bevel adjacent its sealing edge flares outwardly so that the elastic sealing member 16 is also enlarged toward both sides at the sealing plane 8*a'*.

The sealing strip 16 is described in German utility patent 7,241,300 and comprises preferably an asbestos plait, the fiber bunches of which are coated with graphite on their surfaces. Tests have shown that with such sealing strips, the asbestos fiber does not change under the influence of temperature, its elastic properties remain rather unchanged, even if, after a certain time, they become encrusted with pitch deposits from tar mists.

While specific embodiments of the invention have been shown and described in detail to illustrate the application of the principles of the invention, it will be understood that the invention may be embodied otherwise without departing from such principles.

We claim:

1. A sealing device for sealing a coke oven door to a door frame, comprising first and second spaced apart metal sealing blades having respective substantially aligned sealing edges adapted to extend outwardly from the edge of the door and abut against the frame in sealing engagement, a metal spacer between said first and second sealing blades having an outer edge spaced inwardly from the sealing edges of said first and second sealing blades, clamping means for mounting said first and second sealing blades and said spacer on a coke oven door, and an elastic sealing strip of a mineral fiber between said first and second sealing blades and having an outer elastic sealing edge substantially in alignment with said blade sealing edges and also abutting tightly against said frame in sealing engagement therewith.

2. A sealing device according to claim 1, wherein said spacer comprises a contour strip having a recess for accommodating said clamping means, said clamping means comprising a bolt extending through said recess.

3. A sealing device according to claim 1, wherein said spacer comprises a strip divided longitudinally into a plurality of strip portions.

4. A sealing device according to claim 1, wherein each of said sealing blades has a bevelled side adjacent the sealing edge with at least one being oriented toward said elastic sealing strip so that said strip is enlarged adjacent said bevel.

5. A sealing device according to claim 4, wherein both of said sealing blades have bevelled sides adjacent said sealing edges which face toward said elastic strip.

* * * * *